US006198380B1

(12) United States Patent
Castellano-Aldave

(10) Patent No.: US 6,198,380 B1
(45) Date of Patent: Mar. 6, 2001

(54) STRAIGHT-LINE POTENTIOMETER

(75) Inventor: Jesus Carlos Castellano-Aldave, Fontellas (ES)

(73) Assignee: Navarra de Componentes Electronicos, SA (ES)

( * ) Notice: Subject to any disclaimer, the term of this patent is extended or adjusted under 35 U.S.C. 154(b) by 0 days.

(21) Appl. No.: 09/408,412

(22) Filed: Sep. 29, 1999

Related U.S. Application Data

(63) Continuation-in-part of application No. 08/646,991, filed on May 8, 1996, now abandoned.

(30) Foreign Application Priority Data

May 8, 1995 (ES) ..... 9500878

(51) Int. Cl.[7] ..... H01C 10/38
(52) U.S. Cl. ..... 338/176; 338/202
(58) Field of Search ..... 338/176, 178, 338/179, 180, 181, 182, 183, 118, 194, 133, 252

(56) References Cited

U.S. PATENT DOCUMENTS 3,412,361 * 11/1968 Lovejoy et al. ..... 338/176
3,550,059 * 12/1970 Barden et al. ..... 338/176
4,053,865 10/1977 Brown, Jr. .
4,274,074 * 6/1981 Sakamoto ..... 338/160
4,426,634 * 1/1984 Okuya et al. ..... 338/161
4,523,176 6/1985 Leibinger et al. .
4,698,613 * 10/1987 Okuya ..... 338/176
4,792,780 12/1988 Takahashi .

* cited by examiner

*Primary Examiner*—Karl D. Easthom
(74) *Attorney, Agent, or Firm*—Garrison & Associates PS; David L. Garrison

(57) ABSTRACT

Straight-line potentiometer including a casing with a longitudinal opening in which slides a carrier having an electroconductive slider which provides electrical contact between an electroconductive slideway and an electroresistive slideway. The slider is provided with a centrally disposed offset portion which is inserted between the lugs of the carrier. The slideways are arranged on opposite sides of the longitudinal opening and run parallel to the opening. The carrier is made up of an operating stem and two resilient lugs, arranged so as to form a fork, extending through the longitudinal opening. The ends of the lugs are further provided with toes which engage the inner edges of the longitudinal opening and allow the carrier and slider to smoothly slide along the opening. The improved straight-line potentiometer is also provided with a plurality of resilient grips situated on opposite ends of the longitudinal line of the carrier and engaging lateral sectors of the slider in a riding arrangement.

12 Claims, 2 Drawing Sheets

FIG. 1
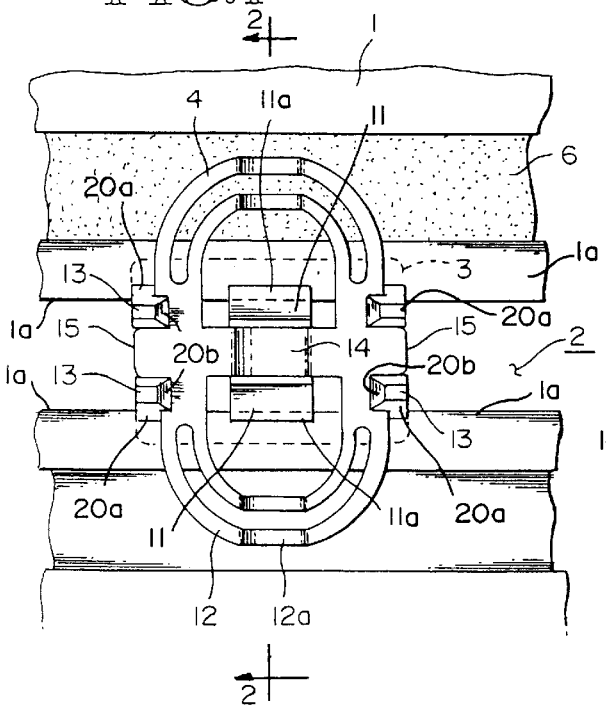
FIG. 1A
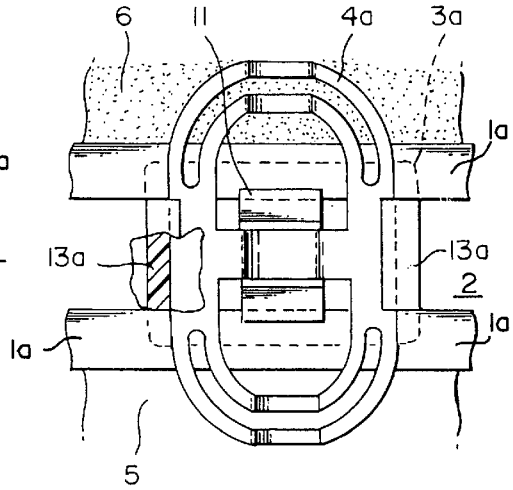
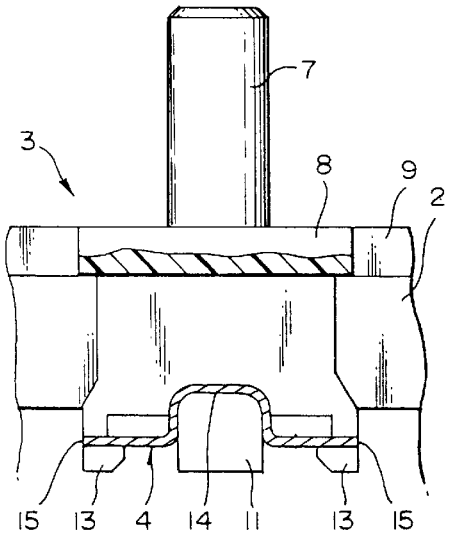
FIG. 2
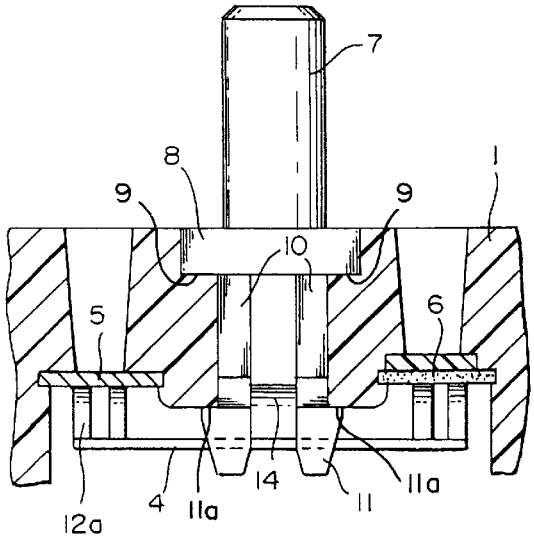
FIG. 3

STRAIGHT-LINE POTENTIOMETER

This application is a continuation in part of application Ser. No. 08/646,991, filed May 8, 1996 now abandoned.

FIELD OF THE INVENTION

The invention concerns improvements in a straight-line potentiometer, in particular of the miniature type and of those employed in electronic units, said improvements providing more reliability, an easy assembly and a lower manufacturing cost.

BACKGROUND OF THE INVENTION

Conventional straight-line potentiometers basically comprise a case with a longitudinal opening having at the sides thereof one or more electric slideways that are parallel to each other, and electroconductive and/or electroresistive, there being generally an electroconductive one for each electroresistive one, as well as a carrier with an operating stem or appendage that is operable to be shifted in a straight-line along the opening, the carrier carrying one or more electroconductive members or sliders forming jumpers between several points of the slideways.

In a known solution of the prior art, the engagement of the slider carrier with the potentiometer casing is carried out by means of two U-shaped or fork-shaped resilient lugs of the carrier, each of the lugs ending in a toe, the toes approaching when being inserted through the longitudinal opening and again spacing themselves apart once having passed the inner surface of the latter, the toes being thus retained at respective inner edges of the longitudinal opening. The electroconductive member forming the slider is attached to the fork-shaped lugs by means of riveting on flat fastening areas at both sides of the lugs, this operation having to be carried out by means of precision robotics due to the reduced dimensions involved. This increases the cost of the product if a correct manufacture of the potentiometer must be guaranteed.

Nevertheless, in the straight-line potentiometer of the prior art, it happens that if any intervention in the pertinent circuit or during the riveting process of the slider, the lugs approach or are deformed by heating, their toes can get at least in part into the longitudinal opening, thus being trapped inside it and preventing the operation of the potentiometer itself. And, if an attempt is made to unblock the carrier by acting on it in order to correct such an anomaly, the slider can be then damaged due to its frail build on account of its reduced dimensions. The gripping provided by said lugs, to a portion of which the slider is fastened by riveting, is not in any case effective or secure, and imposes in any case onerous process costs if a proper completion of the potentiometer is called for.

SUMMARY OF THE INVENTION

The object of the invention consists in obviating the above-mentioned drawbacks by means of a straight-line potentiometer whose improvements essentially consist in providing the slider with a portion, for example by way of an offset portion, which in the assembly process is inserted between the fork-shaped lugs of the carrier thereby totally preventing said lugs from joining and passing again through the opening or getting trapped in it. Said slider is as well provided with tabs which are oriented in opposite directions and are inserted between respective pairs of resilient grips of the carrier, the action of said grips being perpendicular to that of the toes or fork-shaped lugs whereas at the same time said grips exert their gripping action on corresponding edges of said slider thereby firmly retaining it with no need to carry out any riveting whatsoever, with the consequent cost saving and simplicity of the operation; all this as will be explained hereinafter and as claimed in the appended claims.

BRIEF DESCRIPTION OF THE DRAWINGS

FIG. 1 is a plan-view of the inside of the straight-line potentiometer of the invention showing its casing in a cutaway view;

FIG. 1*a* is a view similar to the previous one illustrating an alternative embodiment of the carrier and slider;

FIG. 2 is a longitudinal elevation sectioned along section line II—II of FIG. 1 showing the gripping of the slider by its carrier;

FIG. 3 corresponds to a 90°0 rotation of FIG. 2 showing the potentiometer casing in a sectional and partly cutaway view, as well as the attachment to it of the slider carrier by way of a slide.

DETAILED DESCRIPTION OF A PREFERRED EMBODIMENT

Figure 4:
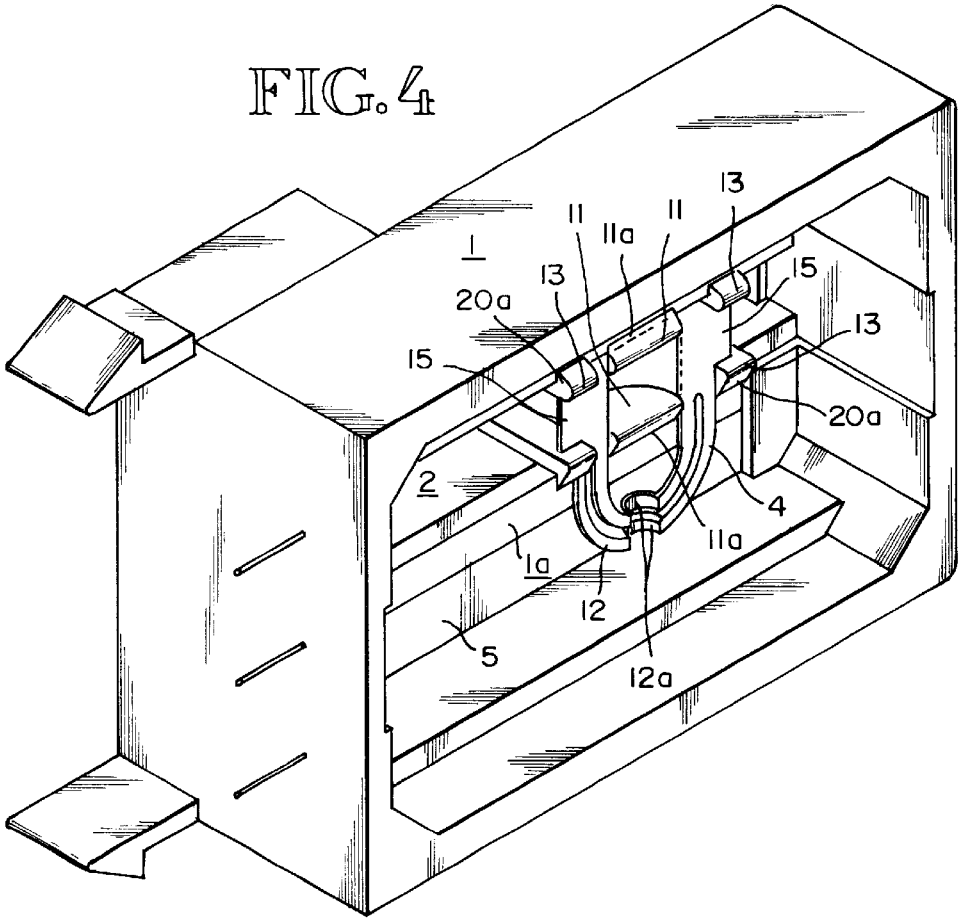
FIG. 4 is a perspective view of the underside of the invention shown in FIGS. 1, 2, and 3, particularly detailing the interaction of the slider and lug grips with the case and slideways.

Referring to the several Figures, the invention is essentially comprised of case (1) having a first side and a second side substantially defining longitudinal opening (2), as is best shown in FIG. 3. Case (1) is preferably formed from a dielectric material such as plastic.

Also disposed on case (1) are a pair of slideways (5) and (6). Slideway (5), which is arbitrarily chosen as electroconductive and slideway (6), which is arbitrarily chosen as electroresistive. Both slideways (5) and (6) are disposed on the underside of case (1) and are generally parallel to one another and longitudinally arranged at respective sides of opening (2).

Referring next to FIG. 3, disposed in longitudinal opening (2) is slide carrier (3). Carrier (3) is comprised of outer stem (7) and enlargement (8), and slides on longitudinal guides (9) provided by way of a step flanking opening (2). Two resilient and sensibly wide lugs (10) extend from enlargement (8), forming a fork-like structure in such a way that lugs (10) are insertable into opening (2) and terminate in corresponding toes (11). Toes (11) each have a return portion (11*a*) that extends perpendicular to the axis of carrier (3) travel and extends over and compressively contacts case (1) at longitudinal portion (1*a*). Because of the inherently resiliency of lugs (10), the same are deflected upon insertion of carrier (3) into opening (2) and spring back to their original position when no longer interfering with the walls of case (1) that define opening (2). After insertion, enlargement (8) rides upon guides (9) and return portions (11*a*) ride upon longitudinal portion (1*a*) as is best shown in FIG. 3.

Also extending from enlargement (8) is a pair of grip portions (13), which are best shown in FIGS. 1 and 2. In a first embodiment, grip portions (13) function to retain slider (4) in carrier (3) as will later be described.

In order to retain slider (4) in carrier (3) each grip (13) has a return portion (20*a*). This return portion exerts a compressive force upon slider (4) that is opposed by the portion of slider (4) that contacts slideways (5) and (6), namely inflexions (12*a*), as is best shown in FIGS. 3 and 4. Slider (4), which will be described in greater detail below, is insertable under return portions (20*a*) of grips (13) by way of flexing it in its longitudinal direction, i.e., perpendicular to longitudinal opening (2).

In order to retain slider (4) in carrier (3), each grip (13) has a second return portion (20*b*). This return portion exerts a compressive force upon slider (4) that is opposed by the portion of slider (4) that contact slideways (5) and (6), namely inflexions (12*a*), as is best shown in FIG. 3. Slider (4), which will be described in greater detail below, is insertable under return portions (20*b*) of grips (13) by way of flexing it in its longitudinal direction, i.e., perpendicular to longitudinal opening (2).

Slider (4) is comprised of two arcuate portions or arms (12), which are resilient and at their middle end parts have respective pairs of inflexions (12*a*) which are tangential to corresponding slideways (5) and (6). These inflexions, in conjunction with offset (14), permit slider (4) to be flexible about its longitudinal axis. As previously described, this attribute permits the insertion, and removal, of slider (4) from carrier (3).

Tabs (15) of slider (4) permit the positive location of slider (4) in carrier (3) so as to prevent off-axis movement of the slider when the invention is operated by a user.

FIG. 1*a* shows an alternative embodiment of carrier (3*a*) wherein the carrier (3) include resilient grips (13*a*), which are facing each other and situated at opposite ends of a longitudinal line of carrier (3*a*). Grips (13*a*) are again provided to grip slider (4*a*) (which is in this case devoid of tabs (15)) by gripping in a riding arrangement lateral sectors of slider (4*a*). In this embodiment grips (13*a*) do not derive from end edges or corners of lugs (10) as in previous embodiment of FIG. 1 but from the enlargement (8). Return portion (20*b*') extends across the width of opening (2).

What is claimed is:

1. A straight line potentiometer comprising:

a case having a first side and a second side, and defining a longitudinal opening extending from the first side to the second side;

at least a pair of conductive slideways located on the case, adjacent to the longitudinal opening;

a carrier having a stem extending in a first direction and two resilient lugs extending in a second direction substantially opposite to the first direction and spaced apart from one another, wherein the two resilient lugs each terminating in a toe having a return portion slidingly engaging the second side of the case thereby retaining the carrier to the case, and wherein the carrier is formed to partially fit within the longitudinal opening whereby the stem extends beyond the first side of the case and the toes and return portion terminating the lugs extend beyond the second side of the case when the carrier is disposed in the case opening;

resilient grips deriving from the carrier;

an electrically conductive slider having a first side and a second side, and engaged with the carrier by way of the resilient grips so that the first side of the slider physically contacts the slideways during operation of the potentiometer to provide electrical contact between the slideways; and an offset portion of the slider between the lugs of the carrier thereby totally preventing the lugs from joining and passing through the opening.

2. The potentiometer of claim 1 wherein the resilient grips extend from an enlargement located between the stem and the pair of lugs.

3. The potentiometer of claim 1, wherein the return portions terminating the lugs extend in a direction generally perpendicular to the longitudinal opening.

4. The potentiometer of claim 1 wherein each of the resilient grips has a return portion exerting a compressive force upon the slider that is opposed by the portion of slider that contacts the slideways, the action of the return portion of the resilient grips being perpendicular to that of the return portion of the toes terminating the lugs.

5. The potentiometer of claim 4 wherein the return portion of the toe terminating each lug and the return portion of each resilient grip define a space so as to permit the offset portion of the slider to reside therebetween.

6. The potentiometer of claim 1 wherein the slideways are located on the second side of the case and are positioned substantially parallel to the longitudinal opening and displaced slightly away from the opening.

7. The potentiometer of claim 1 wherein conductive slideways are comprised of one electroconductive and one electroresistive member.

8. The potentiometer of claim 1 wherein the carrier has an enlargement between the stem and the two resilient lugs.

9. The potentiometer of claim 8 wherein the first side of the case defines a recess sized to slidingly receive the enlargement.

10. The potentiometer of claim 1 wherein the lugs are sensibly wide and the resilient grips derive from the lugs.

11. The potentiometer of claim 1 wherein the slider is generally planar except for the area contacting the slideways.

12. The potentiometer of claim 1 wherein the slider is provided with tabs which are oriented in opposite directions and are inserted between respective pairs of resilient grips of the carrier.

* * * * *